US008286693B2

(12) United States Patent
Whitney et al.

(10) Patent No.: US 8,286,693 B2
(45) Date of Patent: Oct. 16, 2012

(54) HEAT SINK BASE PLATE WITH HEAT PIPE

(75) Inventors: Bradley R. Whitney, Epsom, NH (US); Sukhvinder S. Kang, Concord, NH (US)

(73) Assignee: Aavid Thermalloy, LLC, Concord, NH (US)

( * ) Notice: Subject to any disclaimer, the term of this patent is extended or adjusted under 35 U.S.C. 154(b) by 1034 days.

(21) Appl. No.: 12/148,192

(22) Filed: Apr. 17, 2008

(65) Prior Publication Data

US 2009/0260782 A1 Oct. 22, 2009

(51) Int. Cl.
*F28F 7/00* (2006.01)
*H05K 7/20* (2006.01)

(52) U.S. Cl. ..... 165/104.21; 165/80.3

(58) Field of Classification Search ..... 165/80.3, 165/104.21, 104.26, 185, 80.5; 361/700, 361/704; 257/715; 174/15.2
See application file for complete search history.

(56) References Cited

U.S. PATENT DOCUMENTS

| | | | | |
|---|---|---|---|---|
| 4,036,286 | A * | 7/1977 | Anderson et al. | 165/45 |
| 5,564,497 | A | 10/1996 | Fukuoka et al. | |
| 5,829,516 | A | 11/1998 | Lavochkin | |
| 6,163,073 | A | 12/2000 | Patel | |
| 6,435,266 | B1 | 8/2002 | Wu | |
| 6,626,233 | B1 | 9/2003 | Connors | |
| 6,650,540 | B2 * | 11/2003 | Ishikawa | 361/695 |
| 6,651,732 | B2 * | 11/2003 | Sagal | 165/80.3 |
| 6,688,380 | B2 | 2/2004 | Lavochkin et al. | |
| 6,915,844 | B2 * | 7/2005 | Chou | 165/104.33 |
| 7,028,758 | B2 | 4/2006 | Sheng et al. | |
| 7,059,391 | B2 | 6/2006 | Whitney | |
| 7,117,930 | B2 | 10/2006 | Todd et al. | |
| 7,306,027 | B2 | 12/2007 | Whitney et al. | |
| 7,342,788 | B2 * | 3/2008 | Nikfar | 361/700 |
| 7,487,825 | B2 * | 2/2009 | Yu et al. | 165/185 |
| 7,520,316 | B2 * | 4/2009 | Xia et al. | 165/80.3 |
| 7,597,134 | B2 | 10/2009 | Min et al. | |
| 7,606,030 | B2 * | 10/2009 | Zhou et al. | 361/700 |
| 7,694,718 | B2 * | 4/2010 | Lai et al. | 165/80.3 |
| 7,755,894 | B2 * | 7/2010 | Yang et al. | 361/700 |
| 7,779,897 | B2 | 8/2010 | Jin et al. | |
| 2003/0079862 | A1 | 5/2003 | Moore et al. | |
| 2004/0035558 | A1 * | 2/2004 | Todd et al. | 165/104.26 |
| 2005/0201061 | A1 * | 9/2005 | Nikfar | 361/700 |

(Continued)

FOREIGN PATENT DOCUMENTS

JP 2004/311718 11/2004

*Primary Examiner* — Tho V Duong
(74) *Attorney, Agent, or Firm* — Wolf, Greenfield & Sacks, P.C.; Robert E. Hunt

(57) ABSTRACT

A heat sink assembly includes a base plate having a top surface provided with cooling fins, and a bottom surface with an open channel, the channel having remote regions and a central region with a rectangular cross-section. A heat pipe arrangement including at least two sections is nested in the channel, each section having at least one evaporator section and a condenser section, wherein the evaporator sections are juxtaposed side by side in the central region, and the condenser sections are in respective remote regions. The arrangement is preferably a single S-shaped heat pipe with a pair of hooked ends and a center section which form the evaporator sections, the evaporator sections each having a rectangular profile and an exposed surface which is flush with the bottom surface of the base plate, the condenser sections connecting the evaporator sections and being recessed below the bottom surface.

25 Claims, 4 Drawing Sheets

U.S. PATENT DOCUMENTS

2005/0247437 A1* 11/2005 Ying et al. ..... 165/104.33
2005/0284614 A1* 12/2005 Machiroutu et al. ..... 165/104.26
2006/0096738 A1 5/2006 Kang et al.
2006/0203451 A1* 9/2006 Wei et al. ..... 361/700
2007/0074857 A1 4/2007 Xia et al.
2007/0107871 A1* 5/2007 Xia et al. ..... 165/80.3
2007/0151711 A1* 7/2007 Chen et al. ..... 165/104.33
2007/0240856 A1* 10/2007 Liu et al. ..... 165/104.26
2008/0142192 A1 6/2008 Yu et al.
2009/0159252 A1* 6/2009 Lai et al. ..... 165/171
2009/0266513 A1 10/2009 Xiong et al.

* cited by examiner

HEAT SINK BASE PLATE WITH HEAT PIPE

BACKGROUND OF THE INVENTION

1. Field of the Invention

The invention relates to a heat sink of the type having base plate and a heat pipe with a flat surface which is brought into contact with a device to be cooled, such as a central processing unit (CPU).

2. Description of the Related Art

Heat sinks utilizing heat pipes are well known. A heat pipe generally consists of a tube forming a closed volume containing a heat transfer fluid which is present in two phases. The tube is preferably lined with a wicking material which distributes the liquid phase within the closed volume, and in particular draws it from a condenser section back toward an evaporator section. The condenser section is generally in contact with cooling fins or other means for removing heat, while the evaporator section is in contact with the device to be cooled.

U.S. Pat. No. 7,059,391 discloses a heat sink utilizing a base plate having a pair of slots in which the ends of a heat pipe are received to form a evaporator sections which are mounted on a CPU. The exposed portions of the heat pipe on the bottom surface of the plate may be machined to present a flat surface to the CPU. The condenser section is formed by a loop of the heat pipe which passes over a wall on the top side of the heat sink and is flanked by cooling fins extending parallel to the plate. This is a relatively high profile design which is not suitable for applications where space above the mounting surface is limited.

U.S. Pat. No. 7,117,930 in FIG. 7 discloses a heat sink with a base plate having a bottom surface in which a central portion of a heat pipe is press fit so that it forms an evaporator section which is flush with the bottom surface. Here too the exposed portions of the heat pipe may be machined so as to be flat and smooth. The condenser section of the heat pipe is formed by ends of the heat pipe which extend upward from the top surface through cooling fins which are parallel to the plate. Since the base plate is designed to be extruded, the long sections of heat pipe which form the evaporator section cover a large area, which does not cool a highly concentrated heat source such as a CPU with great efficiency.

US 2007/0074857 discloses a heat sink including a base plate having a top surface provided with grooves, and an opposed bottom surface which is installed against a CPU. Multiple heat pipes, in particular two pairs of U-shaped heat pipes, are installed in the grooves so that one arm of each heat pipe is juxtaposed against respective arms of other heat pipes to form evaporator sections directly opposite from the area of the bottom surface which contacts the CPU. The heat pipes are coplanar with the top surface, which is provided with cooling fins.

FIG. 9 illustrates another heat pipe arrangement according to the prior art. Here an open channel in the surface of a plate accommodates a pair of U-shaped heat pipes, wherein each arm of each heat pipe is juxtaposed against a respective arm of the other heat pipe. The entire arrangement is recessed below the surface of the plate, which is intended for mounting against a heat sink. The object or objects to be cooled, such as a CPU, are mounted against the opposite surface without regard to the position of the heat pipes. As such, no particular sections of the heat pipes serve as evaporator sections or condenser sections; the device is intended to be used as a heat spreader.

In general, heat sinks utilizing heat pipes are limited in their heat removal ability, because the fluid has only one path returning to the evaporator along the length of the pipe, and the heat source is only partially covered by the evaporator section. Vapor chambers can spread the heat generated by high power components over a large area of the base plate, but are relatively expensive, less robust structurally, and difficult to seal. An example of a vapor chamber is disclosed in U.S. Pat. No. 7,306,027.

While heat sinks having heat pipes with evaporator sections covering the heat sink are known (US 2007/0074857), the amount of metal interposed between the vaporizing fluid and the object to be cooled offers higher than optimal thermal resistance and therefore worse performance.

The prior art points to a need for a heat sink having the heat removal advantages of a vapor chamber, but the structural strength and lower manufacturing cost of a heat pipe design.

SUMMARY OF THE INVENTION

According to the invention, a base plate for a heat sink is provided with an open channel in one surface, cooling fins on the opposite surface, and a heat pipe arrangement nested in the channel. The channel has at least one first or remote region with a first width, and a second or central region having a second width which is greater than the first width. The heat pipe arrangement has at least two evaporator sections juxtaposed side by side in the central region of the channel, and two condenser sections in respective remote regions of the channel. The evaporator sections are brought into direct contact with an object to be cooled, typically a CPU, so that the higher thermal resistance offered by an intervening metal plate is eliminated.

The heat pipe arrangement may be formed as discrete heat pipes, or as a single heat pipe, which may be in the form of an S having a center section and hooked ends which form the evaporator sections.

By having multiple evaporator sections juxtaposed in the central region of the channel, and multiple condenser sections in respective remote regions of the channel, thermal characteristics allowing heat spreading comparable to that of a vapor chamber are obtained, while allowing multiple cost, weight, and performance trade-offs, e.g. the use of lighter and less costly aluminum in place of copper for the base plate.

Heat transfer in the evaporator sections is maximized by providing the central region of the channel with a rectangular cross-section, and flattening the heat pipe sections in this region so that they have a rectangular profile with a collective width which is the same as the width of the central region of the channel.

According to another aspect of the invention, the portions of the heat pipe in the central region are coplanar with the bottom surface of the base plate, whereas the portions of the heat pipe in the remote regions are recessed from the bottom surface. This assures that the machining operation which is performed to achieve coplanarity of the evaporator sections cannot render the tubing wall too thin in other areas, which could cause leakage at an imperfection in the grain structure. The thinner wall section of the heat pipes produced by machining the exposed surfaces of the evaporator sections also improves the efficiency of the device, because the effective thermal conductivity of the evaporating fluid is vastly higher than that of metal. For example, while copper has a thermal conductivity of 380 W/m-° K., evaporating water has an effective thermal conductivity in excess of 10,000 W/m-° K. Thus, reducing the wall thickness of the heat pipe, which is typically about 0.5 mm, by up to 50%, further improves the rate of heat transfer from the CPU to the fluid.

According to a further aspect of the invention, the base plate serves as a forming die for the heat pipe. That is, the heat pipe is first bent to a shape corresponding to the channel machined in the base plate, and the heat pipe or heat pipes are placed in the channel. At this point the heat pipe still has a substantially round profile throughout. A platen with raised sections corresponding to remote regions of the channel is then brought to bear against the bottom surface of the base plate, thereby deforming the heat pipe to form desired cross-sectional profiles. The heat pipe is then soldered or bonded in place, and the bottom surface is milled to provide the coplanarity which assures good thermal contact with the device to be cooled.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
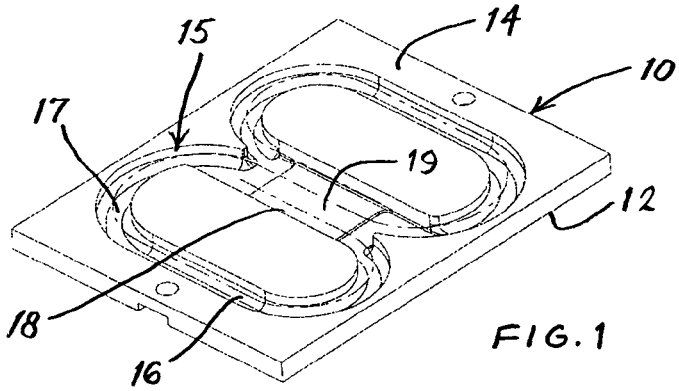
FIG. 1 is a perspective view of a base plate having a "double oval" open channel with a central region and remote regions.

FIG. 1 shows a copper base plate 10 which is inverted so that its top surface 12 faces down and the opposed bottom surface 14 faces up. These surfaces are designated as "top" and "bottom" because the bottom surface would generally be placed over an element to be cooled, such as an IC chip on a circuit board. However it will be understood that the plate 10 can also be mounted against a chip on a vertical surface or even on the underside of a circuit board. In every case, it is intended that the bottom surface 14 is in contact with the element to be cooled.

Figure 2:
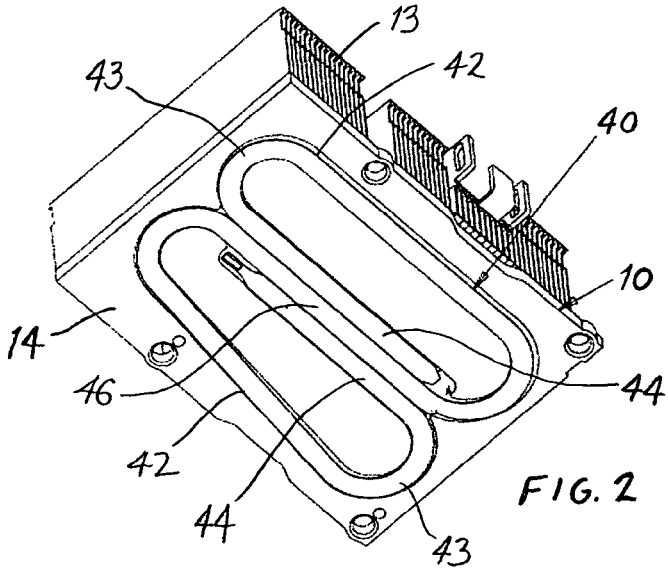
FIG. 2 is a perspective view of a heat sink with an S-shaped heat pipe having a center section and hooked ends.

The top surface 12 is provided with cooling fins 13, which are omitted here but shown in FIG. 2. The bottom surface 14 has a channel 15 with first or remote regions 16 having a floor 17, and a second or central region 18 having a floor 19, where the floor 19 is raised with respect to the floor 17. As shown in this view, the channel 15 has an overall shape resembling two ovals which are siamesed to form a central region 18 having a width which is greater than the width of the remote regions 16.

FIG. 2 shows a heat sink having a single S-shaped heat pipe 40 which is nested in the channel 15 of FIG. 1. The heat pipe 40 has a pair of first arms 42 nested in the remote regions 16 of the channel 15, a pair hooked ends which form the second arms 44, a bight 43 connecting each pair of arms 42, 44, and with a center section 46 lying between the second arms 44 in the central region 18 of the channel. The first arms 42 are closely fitted in the remote regions 16 but do not protrude above the bottom surface 14. The second arms 44 are juxtaposed against the center section 46 in the central region 18, which has a raised floor and a substantially rectangular cross section. The width of the central region 18 substantially equals the collective width of the second arms 44 and the center section 46, which collectively have a substantially rectangular cross section, and preferably each have a substantially rectangular cross section. The exposed surfaces have been milled to be coplanar with the bottom surface 14 of the base plate.

Figure 3:
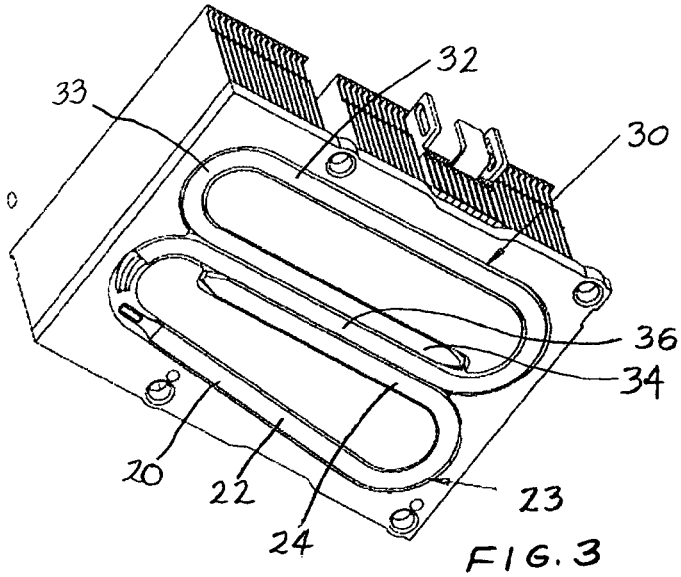
FIG. 3 is a perspective view of a heat sink with a heat pipe with a U-shaped section having a hooked end.

FIG. 3 shows a heat sink having two discrete heat pipe sections fitted into a channel 15 in the base plate 10 of FIG. 1. A first U-shaped heat pipe section 20 has a first arm 22 in a remote region 16, a second arm 24 in the central region, and a bight 23 connecting each pair of arms 22, 24. A second heat pipe section 30 has a first arm 32 in a remote region 16 of the channel, a second arm 34 in the central region 18 of the channel, a bight 33 connecting the arms 32, 34, and a hooked end 36 which runs parallel to the second arm 34 in the central region 18. The first arms 22, 32 and the bights 23, 33 are closely fitted in the remote regions 16 but do not protrude above the bottom surface. The hooked end 36 lies between the second arms 24, 34 in the central region 18, which has a raised floor and a rectangular cross-section. The width of the central region 18 substantially equals the collective width of the second arms 24, 34 and the hooked end 36, which also have a collectively rectangular cross sections. Here too the exposed surfaces have been milled to be coplanar with the bottom surface of the base plate. Note that if the hooked end 36 is characterized as a second arm and the second arm 34 is characterized as a hooked end, then the second arm lies between the hooked end and the second arm 24. Either way, the heat pipe section 30 can be seen as a U-shaped section having a hooked end which overlaps the second arm.

Figure 4A:
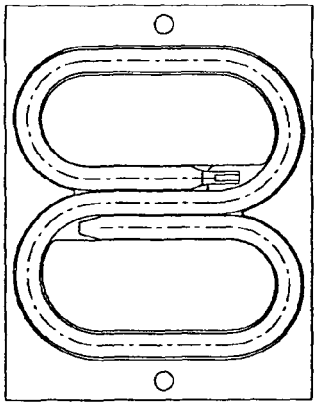
FIGS. 4A-4H are plan views of possible heat pipe arrangements according to the invention.
Figure 4B:
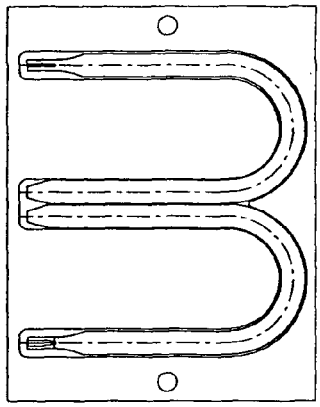
Figure 4C:
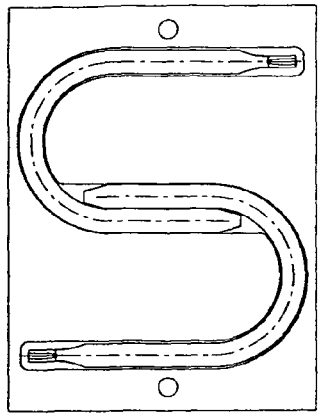
Figure 4D:
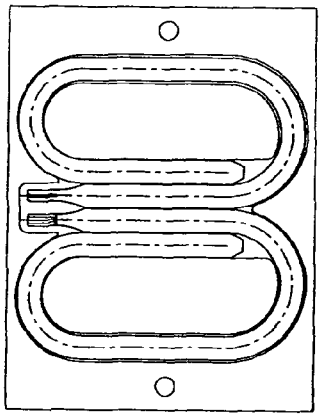
Figure 4E:
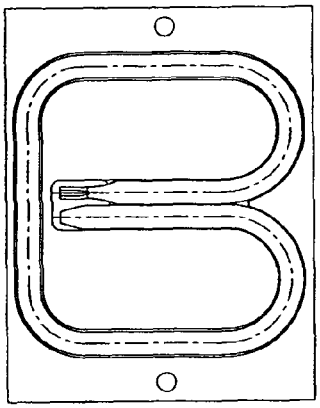
Figure 4F:
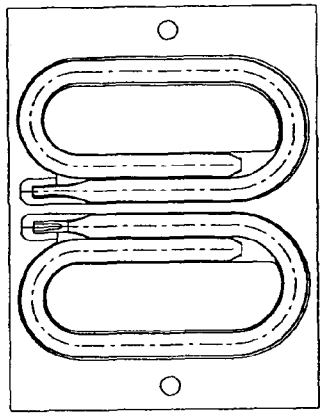
Figure 4G:
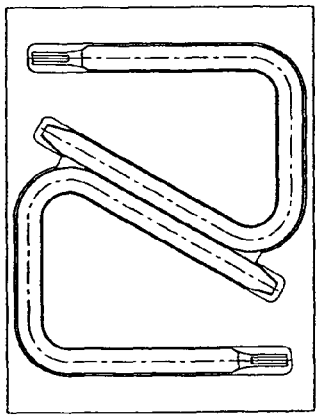
Figure 4H:
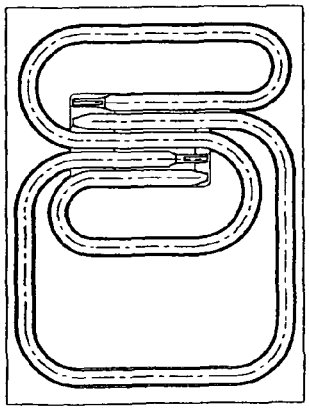

FIGS. 4A-4H illustrate several possible heat pipe arrangements according to the invention. Since the configurations are largely self-explanatory, reference numerals have been omitted for simplicity. FIG. 4A shows a heat pipe arrangement formed as a single heat pipe, substantially as shown in FIG. 2. FIG. 4B shows two discrete U-shaped heat pipes arranged side-by-side, with side-by-side bights. FIG. 4C shows discrete U-shaped heat pipes, wherein the evaporator section of each heat pipe is received between the evaporator and condenser sections of the other heat pipe, so that the bights are oppositely directed. FIG. 4D shows two discrete heat pipes, each heat pipe being formed as a U-shaped section with a hook, so that there are four juxtaposed evaporator sections. FIG. 4E shows a single heat pipe arrangement with two side-by-side U-shaped sections, wherein the condenser sections are connected by a bridge extending across the ends of the evaporator sections. FIG. 4F shows a pair of discrete heat pipes as in FIG. 4D, however here the inside evaporator sections of the respective heat pipes are not juxtaposed. This is the only embodiment shown, which has two separate channels with separate second sections receiving separate pairs of juxtaposed evaporator sections. FIG. 4G shows discrete heat pipes formed as modified U-shaped sections, having side-by-side evaporators and oppositely directed bights. FIG. 4H shows two discrete heat pipes, wherein one is substantially S-shaped to form three evaporator sections, which are separated by the two evaporator sections of the other heat pipe. Numerous other configurations with juxtaposed evaporator sections are also possible; in every case it is desirable for the channel in the base plate to be profiled so that the evaporator sections are coplanar with the bottom surface, while the condenser sections are recessed.

Figure 5:
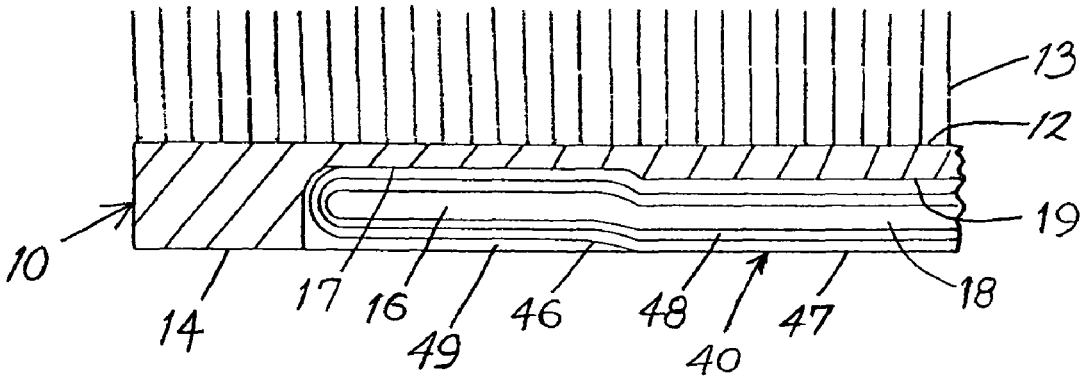
FIG. 5 is a longitudinal section view taken through the central region of the heat sink of FIG. 2.
Figure 6:
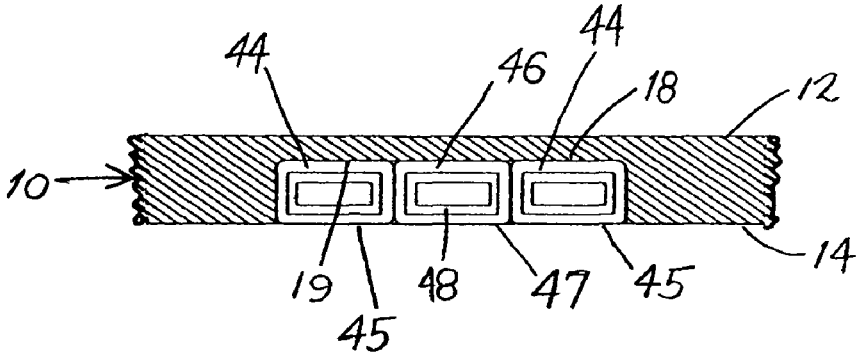
FIG. 6 is a transverse section taken through the central region of the heat sink of FIG. 2.

FIG. 5 shows a section of the heat sink of FIG. 2, taken longitudinally through the central region 18 of the channel 15, and the center section 46 of the S-shaped heat pipe 40. Here it can be seen that the floor 19 in the central region 18 is higher than the floor 17 in the remote regions 16. It can also be seen that the exposed surface 45 of the center section 46 is coplanar with the bottom surface 14 of the base plate 10, whereas the portions of the heat pipe outside the central region 18 are recessed from the bottom surface 14. The area above these portions is preferably filled with solder 49, which is milled with the exposed surface 45 of the center section 46 and the juxtaposed second arms 44 (FIG. 6). It is also possible to fill with epoxy, or (where heat pipe is soldered or bonded in the channel) to omit filling. The opposite or top surface 12 is provided with cooling fins 13 to dissipate heat which is spread by the vapor in the heat pipe and the base plate. Other heat dissipating means, e.g. a cold plate, may be disposed against the top surface. An example of a cold plate is disclosed in U.S. Pat. No. 5,829,516, which is incorporated herein by reference.

FIG. 6 is a transverse section of the heat pipe 40 of FIG. 2, taken through the central region 18 of the channel 15, the center section 46 of the heat pipe 40, and the second arms 44 of the heat pipe 40. The cooling fins 13 have been omitted for simplicity. The central region 18 has a substantially rectangular cross section, and a width which substantially equals the collective width of the arms 44 and center section 46, which collectively have a rectangular cross section. The exposed portions of the heat pipe 40 over the raised floor 19, i.e. the surfaces 45 of the second arms 44 and the surface 47 of the center section 46, have been milled to be coplanar with the bottom surface. As mentioned above, this also reduces the wall thickness of the heat pipe, which decreases thermal resistance between the CPU and the evaporating fluid. The inside of the heat pipe 40 is lined with sintered copper 48, which serves as a wicking material. This ensures that condensate will be drawn from the first arms 42 and the bight 43, which serve as a condenser section, back to the second arms 44 and the center section 46, which serve as an evaporation section.

Figure 7:
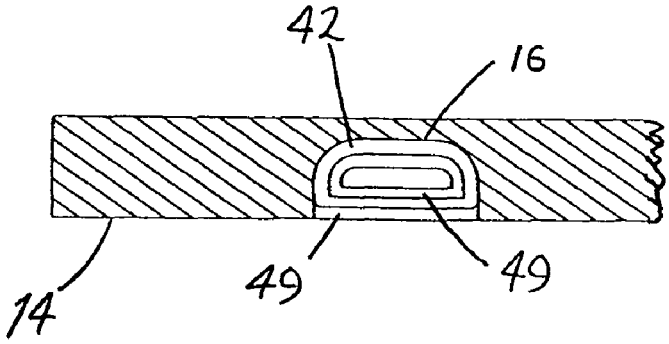
FIG. 7 is a transverse section taken through a remote region of the heat sink of FIG. 2.

FIG. 7 is a transverse section taken through a remote region 16 of the channel 15, and one of the first arms 42. Here the heat pipe 40 is recessed below the bottom surface 14, and the channel is filled with solder 49 over the heat pipe.

Manufacture of the heat sink according to the invention will now be described. The base plate 10 is preferably machined to provide the channel 15 with floor contours as shown in FIG. 1. It is also possible to produce the channel by casting, molding, or impact extrusion. While the base plate may be made of copper, it can also be made of aluminum, or aluminum plated with nickel in order to facilitate soldering. The configuration of the channel will depend on the configuration of the heat pipe or pipes to be used. In every case it is desired that the heat pipe(s) will be closely accommodated in the base plate in the finished heat sink, and that portions of the heat pipe in the central region will be flush with the bottom surface of the base plate.

The heat pipe is preferably made of copper tubing which is lined with wicking material according to known methods. These methods typically entail placing a mandrel in a straight section of tubing, filling the concentric gap with copper grains, and heating to sintering temperature for the time necessary to create a well bonded yet porous wicking structure. It is also possible to use a grooved wick heat pipe, a mesh/twisted wire wick heat pipe, or a heat pipe with a copper foam wick. The heat pipe is subsequently bent to a shape corresponding to the channel machined in the base plate, and the section or sections are placed in the channel, which has been coated with solder paste. At this point the heat pipe still has a substantially round profile throughout. The depth of the channel should be greater than the radius of the heat pipe; this prevents the pipe from spilling over onto the bottom surface of the base plate when it is deformed. A flat platen is then brought to bear against the bottom surface of the base plate, thereby deforming the heat pipe so that it is substantially flush with the bottom surface. Due to resilience of the metal, it will resile so that it is slightly proud of the bottom surface after the platen is lifted. Where the depth of the channel is less than the radius of the pipe, it is possible to emplace a template during the initial stages of deformation, to prevent the pipe from spilling over.

Following initial deformation of the heat pipe using a platen, a specially profiled die is pressed against the heat pipe to deform it so that the sections of heat pipe in the remote regions of the channel, i.e. the condenser sections, are recessed below the bottom surface of the base plate, whereas the sections of heat pipe in the central region, i.e. the evaporator sections, remain slightly proud of the bottom surface. Rather than having a preliminary deformation step using a flat platen, or a flat platen and a template, it is also possible to use a template and a profiled platen, or just a profiled platen, depending on the dimensions of the channel and the heat pipe.

The plate with the deformed pipe in the channel is then placed on a hot plate, which causes the solder in the paste to melt and bond the heat pipe in place. As an alternative to applying paste to the channel prior to deforming the heat pipe, liquid solder flux followed by solder can be added after deformation. Alternatively, the flux can be mixed with the solder to form solder paste. In either event, capillary forces cause the solder to flow into the small gaps between the heat pipe and the channel walls. It is also conceivable to use adhesive instead of solder, but this would require attention to viscosity and surface tension properties.

Figure 8:
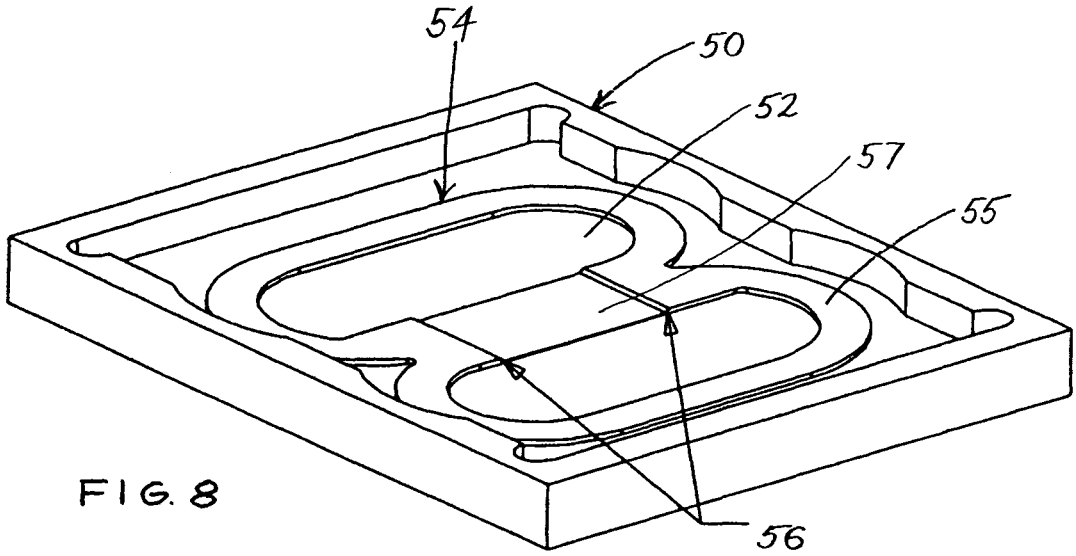
FIG. 8 is a perspective view of forming die which is used to form the heat pipe of FIG. 2 on the base of FIG. 1.
Figure 9:
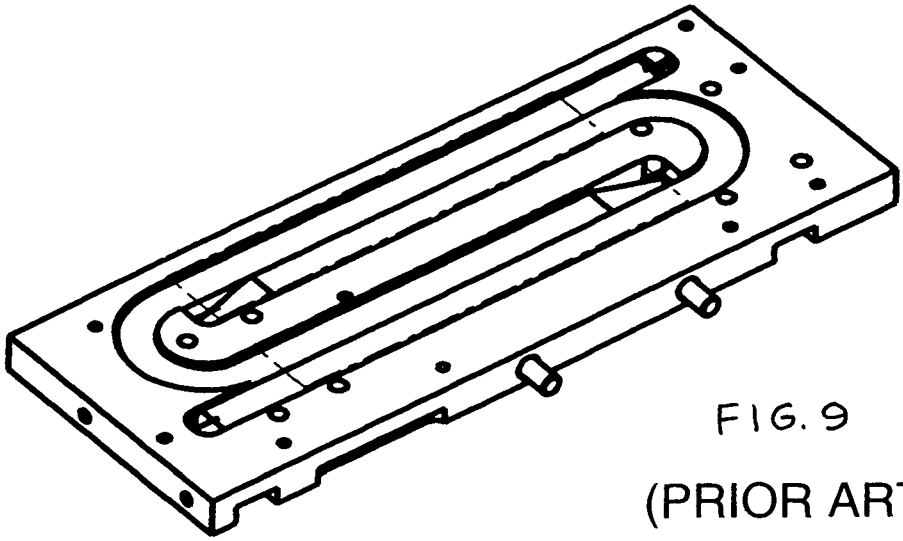
FIG. 9 (PRIOR ART)
FIG. 9 is a perspective view of a heat pipe arrangement according to the prior art.

FIG. 8 shows a forming die 50 having a flat surface 52 which is brought flushly against the bottom surface 14 of base plate 10, and a raised portion 54 which is shaped substantially as the channel 15 in the base plate. The raised portion 54 has remote portions 55 which deform the condenser sections 42, 43 (FIG. 2), and a central portion 57 which deforms the evaporator sections 44, 46 (FIG. 2). The remote portions 55 are separated from the central portion 57 by steps 56, so that remote portions 55 stand higher, and the condenser sections will be recessed from the bottom surface 14 of the base plate.

After deformation of the heat pipe by the forming die 50, the base plate is heated so that the solder in the channel reflows to retain the heat pipe. It is also possible, at this stage, to fill the channel over the condenser sections with solder. The final step is to mill or fly cut the bottom surface 14 so that any portion of the evaporator sections which stand proud of the bottom surface are rendered coplanar, as shown in FIG. 6. Likewise, any excess solder over the condenser sections can be milled off, but this is not as critical as the coplanarity of the evaporator sections. This step assures that the evaporation section of the heat pipe will have good thermal contact with the device to be cooled, while the chances of a creating a leak in the remote sections during machining is eliminated.

Note that it not essential for the floor in the central region to be raised in order for the heat pipe sections in the central region to be coplanar with the surface of the base plate while the rest of the heat pipe is recessed. If the channel has a uniform depth throughout, the remote regions can be provided with a cross-sectional area which permits deforming the heat pipe to below the surface of the base plate. The cross-sections shown in FIGS. 6 and 7 may thus be achieved without the raised floor.

It is therefore clear that the profile of the channel must be dimensioned to achieve the desired final shape of the heat pipe, because (in cooperation with the platen and the forming die) the base pipe acts as a forming die. If any concavities appear in the heat pipe following deforming, modification of the either the base plate or the forming die is indicated.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A heat sink assembly comprising:

a base plate having a top surface and a bottom surface, the bottom surface having an open channel formed therein, the channel having at least one first region and a second region;

at least one heat pipe contained in said open channel, each said heat pipe comprising at least one evaporator section and at least one condenser section, wherein the at least one evaporator section and at least one condenser section are arranged in the open channel such that a common plane that is parallel to a plane of the bottom surface at the second region passes through both the at least one evaporator section and the at least one condenser section, and wherein at least two evaporator sections are juxtaposed side by side in the second region of said channel, and each said condenser section is in a respective said first region of said channel; and a heat dissipating element which dissipates heat from said top surface of said base plate, said heat dissipating element comprising one of cooling fins and a cold plate on said top surface, wherein said evaporator sections include portions in the second region that are flush with the plane of the bottom surface at the second region, and all portions of the at least one condenser section are recessed below a plane of the bottom surface at the first region.

2. The heat sink assembly of claim 1 wherein the juxtaposed evaporator sections have a collective width which is substantially equal to a second width of the second region.

3. The heat sink of claim 2 wherein said second region has a substantially rectangular profile, said evaporator sections being collectively formed to said substantially rectangular profile.

4. The heat sink assembly of claim 1 wherein said at least one heat pipe comprises two discrete heat pipes, each said heat pipe having at least one evaporator section in said second region.

5. The heat sink assembly of claim 4 wherein each said heat pipe comprises a U-shaped section having a first arm forming said condenser section and a second arm forming said evaporator section, wherein the first arm and the second arm are connected by a bight.

6. The heat sink of claim 5 wherein one of said U-shaped sections is formed with a hooked end which extends parallel to said second arm of said one of said U-shaped sections and forms an evaporator section, said second arms and said hooked end lying in said second region of said channel.

7. The heat sink of claim 1 wherein said at least one heat pipe is a single heat pipe having a plurality of evaporator sections in said second region.

8. The heat sink of claim 7 wherein said heat pipe is formed as an S-shaped section with a pair of hooked ends and a center section which form said evaporator sections.

9. The heat sink of claim 1 wherein, in said second region, said evaporator sections are arranged to be coplanar with said bottom surface at the second region.

10. The heat sink of claim 1 wherein each said first region of said channel is filled with one of solder and epoxy over said condenser section.

11. The heat sink of claim 1 wherein the channel has a floor, the floor in the second region being raised with respect to the floor in the first region.

12. The heat sink of claim 1 wherein the channel is formed substantially in the shape of a pair of juxtaposed ovals.

13. The heat sink of claim 1 wherein the at least one condenser section is flattened to have a substantially oval profile.

14. The heat sink of claim 1 wherein said at least one heat pipe is soldered in said channel.

15. The heat sink of claim 1 wherein said at least one heat pipe contains a fluid which is present in two phases, said at least one heat pipe being lined with a wicking structure which draws condensate of the fluid from the condenser sections toward the evaporation sections regardless of orientation of the heat sink.

16. A heat sink assembly comprising:

a base plate having a top surface and a bottom surface, the bottom surface having an open channel formed therein, the channel having at least one first region with a floor and a second region with a floor; and at least one heat pipe including at least one evaporator section and at least one condenser section arranged in the open channel such that a common plane that is parallel to a plane of the bottom surface at the second region passes through both the at least one evaporator section and the at least one condenser section, said at least one heat pipe having a surface that is flush with said bottom surface in said second region, and said at least one heat pipe having all portions of a condenser section recessed below said bottom surface in said at least one first region.

17. The heat sink assembly of claim 16 wherein said at least one heat pipe is machined flush with said bottom surface over said second region.

18. The heat sink assembly of claim 16 wherein the floor in the second region is raised with respect to the floor in the at least one first region.

19. The heat sink assembly of claim 16 wherein said at least one heat pipe comprises two sections, each section having at least one evaporator section and a condenser section, wherein the evaporator sections are juxtaposed side by side in said second region of the channel, and said condenser sections are in respective said first regions of said channel.

20. The heat sink assembly of claim 16 further comprising a heat dissipating element which dissipates heat from said top surface of said base plate, said heat dissipating element comprising one of cooling fins and a cold plate located on said top surface.

21. The heat sink assembly of claim 1, wherein the open channel is fully contained within the bottom surface of the base plate.

22. A heat sink assembly comprising:

a base plate having a top surface and a bottom surface, the bottom surface having an open channel formed therein, the channel having at least one first region and a second region;

at least one heat pipe contained in said open channel, each said heat pipe comprising at least one evaporator section and at least one condenser section, wherein at least one evaporator section is positioned in the second region of said channel, and each said at least one condenser section is in a respective said first region of said channel, the at least one evaporator section and at least one condenser section being arranged in the open channel such that a common plane that is parallel to a plane of the bottom surface at the second region passes through both the at least one evaporator section and the at least one condenser section, said at least one heat pipe having a surface that is flush with said bottom surface in said second region, and said at least one heat pipe having all portions of a condenser section recessed below said bottom surface in said at least one first region; and a heat dissipating element which dissipates heat from said top surface of said base plate, said heat dissipating element comprising one of cooling fins and a cold plate on said top surface, wherein portions of said at least one evaporator section that are positioned nearest a plane of the bottom surface at the second region have a thinner wall thickness than portions of the at least one condenser section that are positioned nearest a plane of the bottom surface at a respective first region.

23. The heat sink assembly of claim 22, wherein at least two evaporator sections are juxtaposed side by side in the second region of said channel.

24. The heat sink assembly of claim 23, wherein the juxtaposed evaporator sections have a collective width which is substantially equal to a second width of the second region.

25. The heat sink assembly of claim 22, wherein said at least one heat pipe comprises two discrete heat pipes, each said heat pipe having at least one evaporator section in said second region.

* * * * *